US012139874B2

(12) United States Patent
Cardona

(10) Patent No.: US 12,139,874 B2
(45) Date of Patent: Nov. 12, 2024

(54) DEVICE FOR BLOCKING A PASSAGE

(71) Applicant: LIBERVIT, Perpignan (FR)

(72) Inventor: Yvan Cardona, Bompas (FR)

(73) Assignee: LIBERVIT, Perpignan (FR)

( * ) Notice: Subject to any disclaimer, the term of this patent is extended or adjusted under 35 U.S.C. 154(b) by 535 days.

(21) Appl. No.: 17/416,740

(22) PCT Filed: Dec. 11, 2019

(86) PCT No.: PCT/FR2019/053013
§ 371 (c)(1),
(2) Date: Jun. 21, 2021

(87) PCT Pub. No.: WO2020/128232
PCT Pub. Date: Jun. 25, 2020

(65) Prior Publication Data

US 2022/0074162 A1 Mar. 10, 2022

(30) Foreign Application Priority Data

Dec. 21, 2018 (FR) ..... 1874003

(51) Int. Cl.
*E02D 29/12* (2006.01)

(52) U.S. Cl.
CPC ..... *E02D 29/127* (2013.01)

(58) Field of Classification Search
CPC ..... E02D 29/127; E03F 5/0401; E03F 5/02; E06B 9/02; E06B 2009/002
See application file for complete search history.

(56) References Cited

U.S. PATENT DOCUMENTS 4,432,162 A * 2/1984 Foote ..... E06B 9/02 49/55
8,858,114 B2 * 10/2014 Gaspar ..... E02D 29/127 404/26

(Continued)

FOREIGN PATENT DOCUMENTS

CN 104452821 A 3/2015
CN 206308710 U 7/2017

(Continued)

OTHER PUBLICATIONS

International Search Report and Written Opinion from PCT Application No. PCT/FR2019/053013, Apr. 21, 2020.

(Continued)

*Primary Examiner* — Rodney Mintz
(74) *Attorney, Agent, or Firm* — Workman Nydegger

(57) ABSTRACT

A removable obturation device is provided for transversely obstructing a passage delimited by a cylindrical side wall wherein it includes: a) a support and blocking element having a central block supporting a plurality of arms disposed perpendicularly in a radial position with respect to the longitudinal axis of the block and of the side wall, each arm having an extensible rod including a pad intended to be blocked against one the side wall, and b) at least one complementary obturation element extending in a radial transverse plane perpendicular to the longitudinal axis, at least partly in or opposite the space between the arms so as to prevent an individual from falling through the passage. The obstruction element is preferably removably fastened to the support and blocking element.

14 Claims, 14 Drawing Sheets

(56) References Cited

U.S. PATENT DOCUMENTS

| | | | | |
|---|---|---|---|---|
| 9,080,370 | B2 | 7/2015 | Cardona | |
| 9,435,435 | B2 * | 9/2016 | Gavin | F16J 13/065 |
| 9,574,338 | B1 | 2/2017 | Cannon | |
| 2012/0048482 | A1 | 3/2012 | Cardona | |
| 2012/0297691 | A1 * | 11/2012 | Gaspar | E02D 29/14 49/505 |
| 2013/0312338 | A1 | 11/2013 | Gasper | |
| 2016/0122126 | A1 | 5/2016 | Gavin | |

FOREIGN PATENT DOCUMENTS

| | | | | | |
|---|---|---|---|---|---|
| CN | 107791180 | A | | 3/2018 | |
| CN | 108222070 | A | | 6/2018 | |
| CN | 108894254 | A | | 11/2018 | |
| CN | 111894041 | A | * | 11/2020 | E02D 29/12 |
| DE | 102013013520 | A1 | | 2/2015 | |
| ES | 2931213 | A1 | * | 12/2022 | |
| WO | 2005093168 | A1 | | 10/2005 | |
| WO | 2010125270 | A2 | | 11/2010 | |

OTHER PUBLICATIONS

French Preliminary Search Report with Written Opinion from corresponding FR Application No. FR1874003, Oct. 11, 2019.
Office Action from corresponding Chinese Application No. 201980085283.5, May 12, 2022.

* cited by examiner

DEVICE FOR BLOCKING A PASSAGE

TECHNICAL FIELD

The present invention relates to a device for temporarily obstructing a passage, in particular a well for accessing an underground pipe of an underground sewerage network intended to collect and discharge the different waters, whether natural such as run-off water and rainwater or produced by human activity such as wash water, drainage water or waste water (household waste water and black water; gray water), called a manhole, in addition to or as temporary replacement for a manhole cover constituting the lid of the manhole. It has primarily utility and safety purposes: it is about limiting the access to the underground sewerage networks only to professionals (sewer men) and avoiding the accidents on public ways. In case of theft of a manhole cover or of flooding-related displacement or loss, the obturation device according to the invention allows preventing pedestrians from falling during the time of replacement of the cover (frequent problem sometimes causing the death of the victims).

More particularly, the object of the present invention is to provide a device for obturating a manhole which is installed to prevent heavy floods or precipitation with the risk of sewerage overflows or run-off water or flooding, which allows water discharge through the device while preventing pedestrians from falling into the manhole. Another aim is to provide a device provided with fastening means strong enough to withstand the weight of a pedestrian walking over it without separating it from the vertical bearing surfaces and to withstand the weight of a cast-iron manhole cover if the device is placed on the underside thereof. Another aim is to provide a device that can be easily installed in series from a single blocking tool on site.

The manhole covers are most often round, with a diameter slightly larger than that of the hole because it is the simplest shape to produce for preventing the cover from falling to the bottom of the hole, which constitutes a safety factor for sewer men working underground. A square cover, for example, could fall if it was introduced through the diagonal of a square hole. A round shape is also easier to handle for workmen or sewer men, since it is possible to roll it and replace it without having to align it, at least for the covers that can be completely removed, some having a retaining tab and only pivot. In addition, for the hole, the cylindrical shape is the most solid and the simplest shape to avoid its compression by the pressure of the ground surrounding it. The cover has therefore the same shape as the hole.

PRIOR ART

It is known in WO 2010/125270, in the name of the Applicant, an autonomous protection device that allows temporarily obstructing a passage such as a corridor, a door or a window, characterized in that it comprises at least one longitudinally extensible bar, preferably a telescopic bar, operable in extension by a jack, said bar being able to be removably blocked in extension between two wall surfaces delimiting said passage called blocking surfaces, said extensible bar supporting a plurality of obstruction elements to form a protective shield making an obstruction at the level of said passage, preferably said obstruction element(s) being removably fastened thereto. This device allows temporarily obstructing a passage such as a bay or a corridor in order to prevent or delay the crossing of this passage by consenting or non-consenting persons and/or to prevent the projection of objects through said device, in particular from outside to inside or from inside to outside when the device is laid against a door or window. More particularly, this type of device aims at preventing a suicidal defenestration during the arrest of madmen, but also aims at allowing channeling people by temporarily obstructing some passages, for example corridors, during demonstrations or crowd movement in public or private places.

The device of WO 2010/125270 on the one hand is not suitable for the obturation of a cylindrical, in particular circular, passage in a horizontal plane and on the other hand does not meet the specific aims of the present invention in terms of partial obturation allowing the discharge of water without authorizing the passage of pedestrians with a fastening strong enough to withstand the weight of a pedestrian walking over it and the weight of a cast-iron manhole cover if the device is placed on the underside thereof. Finally, it does not allow an easily removable installation in series.

To do so, the present invention provides a removable obturation device for transversely obstructing a passage delimited by a cylindrical side wall characterized in that it comprises:

a) a support and blocking element comprising a central block comprising a longitudinal axis (ZZ') intended to be positioned in the longitudinal axis of said side wall of said passage, supporting a plurality of arms disposed perpendicularly in a radial position (XX', YY') with respect to said longitudinal axis (ZZ'), preferably the different arms being disposed symmetrically with respect to said longitudinal axis (ZZ'); each arm comprising an extensible rod comprising at its free end a pad, preferably fastened in a reversible manner to the end of said extensible rod, able to be blocked in abutment against one said side wall by extension of said extensible rod, and b) at least one complementary obturation element extending in a transverse plane (XX', YY') perpendicular to said longitudinal axis (ZZ') of said passage, at least partly in or opposite the space between said arms so as to prevent an individual from falling through said passage, said obstruction element being preferably removably fastened to said support and blocking element.

This system is possibly intended for several uses. In case of flooding, it is installed to prevent heavy floods or precipitation. In case of theft of a manhole cover, it allows preventing pedestrians from falling during the time of replacement of the cover (a frequent problem in India, sometimes causing the death of victims). In the event of a terrorist attack or perimeter lock down, the system can be used to allow security personnel, such as the police to prohibit the entry to or the exit from undergrounds.

Preferably, the device according to the invention further comprises a removable actuation element able to cooperate with said central block to actuate in extension or retraction said extensible rods of said arms simultaneously, said actuation element preferably comprising first reversible fastening means on said support and blocking element, preferably at said central block.

The axis ZZ' is called longitudinal axis in that it extends in the longitudinal direction of said passage.

More particularly, in the device according to the invention:

said actuation element comprises a geared motor able to actuate in rotation on itself along its longitudinal axis (ZZ') a shaft called motor shaft, and said support and blocking element comprises:

a1) said arms each comprising one said drive shaft disposed in one said longitudinal direction in a perpendicular radial plane (XX', YY') with respect to said longitudinal axis (ZZ') of said central block, each said drive shaft being able to be driven in rotation on itself along its radial longitudinal axis (XX', YY') and able to cooperate with one said extensible rod in coaxial translation by helical link such that said rotation on itself in either direction of said drive shaft causes the translation of said extensible rod in extension or respectively in retraction in one said radial direction (XX', YY'), and a2) one said central block comprising a shaft called input shaft (2*b*) disposed along the longitudinal axis (ZZ') of said central block and able to be actuated in rotation on itself with respect to its longitudinal axis (ZZ') when it cooperates with said motor shaft of said actuation element, and an angle transmission device comprising bevel gears able to cooperate with each other at the ends of said input shaft and said drive shafts so that the rotation on itself along its longitudinal axis (ZZ') of said input shaft simultaneously causes the rotations on themselves of said drive shafts along their axes in their said radial directions (XX', YY').

More particularly, in the device according to the invention, said helical link is of the screw-nut type, said drive shaft comprising an external helical threading forming a screw cooperating with a tubular rod at least one end portion of which forms a nut engaged on the threading of the threaded screw formed by said drive shaft, said nut being prevented from following said rotation of said drive shaft and said tubular rod being guided in said translation by a guide pin of said nut due to the fact that said guide pin cooperates with a rectilinear inner slot of a guide and protection cylinder inside which said drive shaft and one end portion at least of said tubular rod extend coaxially, the free end of the rod comprising said pad always remaining outside said guide and protection cylinder.

Said guide and protection cylinder also acts as a protection for the rod and drive shaft assembly in a helical link.

More particularly, the device according to the invention comprises a single obturation element extending above said arms, able to be removably fastened to said support and blocking element preferably at said central block.

More particularly, said obturation element comprises a hoop linked to a central hub by spokes, said central hub of said hoop being able to be removably fastened to said support and blocking element around said central block so that said spokes of the hoop extend between said arms, preferably along the bisectors of the angles between said arms.

More particularly, said support and blocking element comprises four said arms disposed in a cross at 90° around the central block.

In one variant, said obturation element comprises or cooperates with threads or rubber parts for smoothing a fall between said arms.

In another variant, said obturation element comprises spike elements to deter pedestrian from passing through said passage.

Still more particularly, said actuation element comprises a handwheel-shaped gripping element around said geared motor to which it is fastened.

Still more particularly, said actuation element comprises first reversible fastening means on said obturation element, preferably at a central hub of said hoop-shaped obturation element, the latter comprising second reversible fastening means on said support and blocking element, preferably at said central block.

It is understood that in this embodiment, said actuation element is fastened in a reversible manner on said support and fastening element by means of said obturation element before or after its fastening on said support and blocking element.

Still more particularly, said actuation element comprises a handwheel-shaped gripping element around said geared motor to which it is fastened, said handwheel comprising first reversible locking means allowing the blocking of the reversible fastening of said actuation element on said obturation element, by a movement of relative axial rotation about said longitudinal axis (ZZ') of a magnet ring rotating with respect to said handwheel and on the underside of said handwheel, at least one magnet of said ring being able to cooperate with respectively at least a first metal elastic locking pin in a hole of said obturation element, said first locking pin being able to leave said hole attracted against said magnet, preferably by means of a first spring, when the positioning of said actuation element with respect to said obturation element and the rotation of said ring places said magnet opposite the first elastic locking pin of said obturation element, preferably opposite a first elastic locking pin in a hole at a central hub of said hoop-shaped obturation element.

Still more particularly, said obturation element comprises second reversible locking means allowing a blocking of the reversible fastening on said support and blocking element of the assembly of said actuation element fastened to said obturation element, by movements of relative axial rotation and translation with respect to said support and fastening element of the assembly of said actuation element fastened to said obturation element, along and respectively about said longitudinal axis (ZZ').

These movements of relative axial rotation and translation with respect to said support and fastening element of the assembly of said actuation element fastened to said obturation element, ensure that said actuation element remains fastened to said obturation element.

Still more particularly, said hoop-shaped obturation element and said second reversible locking means comprise:

at a central hub of said hoop-shaped obturation element, at least a second locking pin and a second spring in a cylindrical recess within said central means of the hoop, and on the outer wall of said central block, at least one locking slot comprising a first vertical portion along the longitudinal direction (ZZ') of said block, a second circular-arc portion on the periphery of said block and a third vertical portion, said second circular-arc portion forming the junction of the lower ends of said first and third vertical portions, said first vertical portion being open at its upper end and said third vertical portion being closed at its upper end, so that said second reversible locking means are able to be actuated in locking by:

a first downward vertical translational movement of the assembly of said actuation element fastened to said obturation element with respect to said central block and coaxially therewith along its longitudinal axis (ZZ'), said second locking pin thus being able to be guided in translation in said first vertical slot portion up to its lower end by compressing said second spring in doing so, a second rotational movement of the assembly of said actuation element fastened to said obturation element with respect to said central block, said second locking pin thus being able to be guided in rotation in said second circular slot portion up to the lower end of said third vertical slot portion, keeping said second spring compressed, and a third upward vertical translational movement of the assembly of said actuation element fastened to said obturation element with respect to said central block and coaxially therewith along its longitudinal axis (ZZ'), said second locking pin thus being able to be guided in translation in said third vertical slot portion up to its upper end due to the extension of said second spring.

The present invention also provides a method for setting up an obturation device according to the invention in order to transversely obstruct a passage delimited by a cylindrical side wall characterized in that it comprises the steps of:

a) positioning the device according to the invention in said passage with the extensible rods of said arms in the retracted position, said arms being disposed in a perpendicular radial plane (XX', YY') with respect to said longitudinal axis (ZZ') of said central block itself disposed coaxially with the axis of said passage, and b) actuating, by means of one said actuation element, said arms to block said pads in abutment against the cylindrical wall of said passage by extension of said extensible rods, said actuation element cooperating with said central block to actuate in extension said extensible rods of said arms simultaneously.

Still more particularly, the method for setting up an obturation device according to the invention comprises the additional steps of:

a) positioning said device according to the invention in said passage with the extensible rod of said arms in the retracted position, using a handwheel-shaped gripping element fastened around a geared motor of said removable actuation element, and b) actuating said arms to block said pads in abutment against the cylindrical wall of said passage by extension of said extensible rods using said geared motor of said actuation element, and c) removing said removable actuation element to let in the passage only the assembly of said support and blocking element and said obturation element.

Still more particularly, the method comprises the preliminary steps of:

a1) fastening on said obturation element one said actuation element comprising a handwheel-shaped gripping element, then a2) fastening the assembly of said actuation element assembled with said obturation element on said central block of said support and blocking element.

By doing so, said handwheel-shaped gripping element facilitates the set-up of said obturation element on said support and blocking element, then facilitates the set-up of the obturation device according to the invention 1 with its 3 elements thus assembled in the appropriate position in said passage, then facilitates the removal of said actuation element to use it for the mounting and the set-up of another obturation device according to the invention in another passage.

BRIEF DESCRIPTION OF THE DRAWINGS

Other characteristics and advantages of the present invention will emerge more clearly upon reading the following description, given in an illustrative and non-limiting manner, with reference to the appended drawings in which.

DETAILED DESCRIPTION OF VARIOUS EMBODIMENTS

Figure 1:
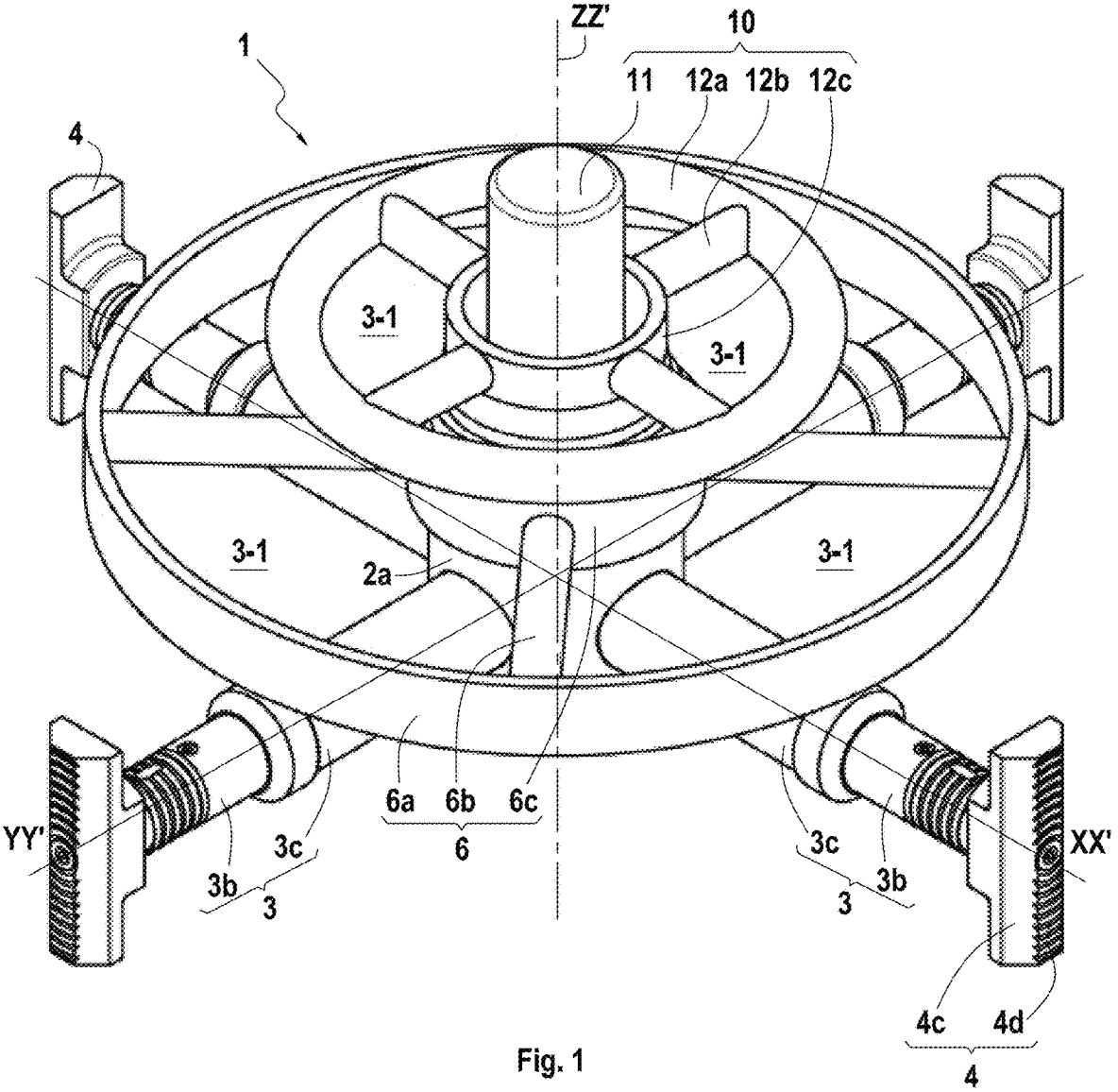
FIG. 1 represents a perspective view of an obturation device according to the invention with one said support and blocking element 2 supporting an obturation element 6 and an actuation element 10.

FIGS. 1 to 11 represent one embodiment of a manhole obturation device according to the invention 1 comprising 3 elements which can be fastened to each other by reversible locking means, namely:

- a support and blocking element 2 comprising a central block 2*a* enclosing an angle transmission bevel gear device 5 cooperating with four arms 3 disposed in a cross with their longitudinal axes in directions XX' and YY' perpendicularly and radially with respect to the axis ZZ' of said central block 2*a* to which they are linked, and
- a complementary hoop-type obturation element 6, and
- an actuation element 10 comprising (a) an electric geared motor 11 able to actuate a motor shaft 11*a* along the axis ZZ' cooperating with the angle transmission device 5 and (b) a handwheel-shaped gripping element 12.

In practice, the fastening of said actuation element 10 is carried out on said obturation element 6, which facilitates the fastening of said obturation element 6 on said central block 2*a* of said support and blocking element 2 with said handwheel-shaped gripping element 12. Then, said handwheel-shaped gripping element 12 facilitates the set-up of said obturation device according to the invention 1 with its 3 thus assembled elements 2, 3 and 10.

Figure 2A:
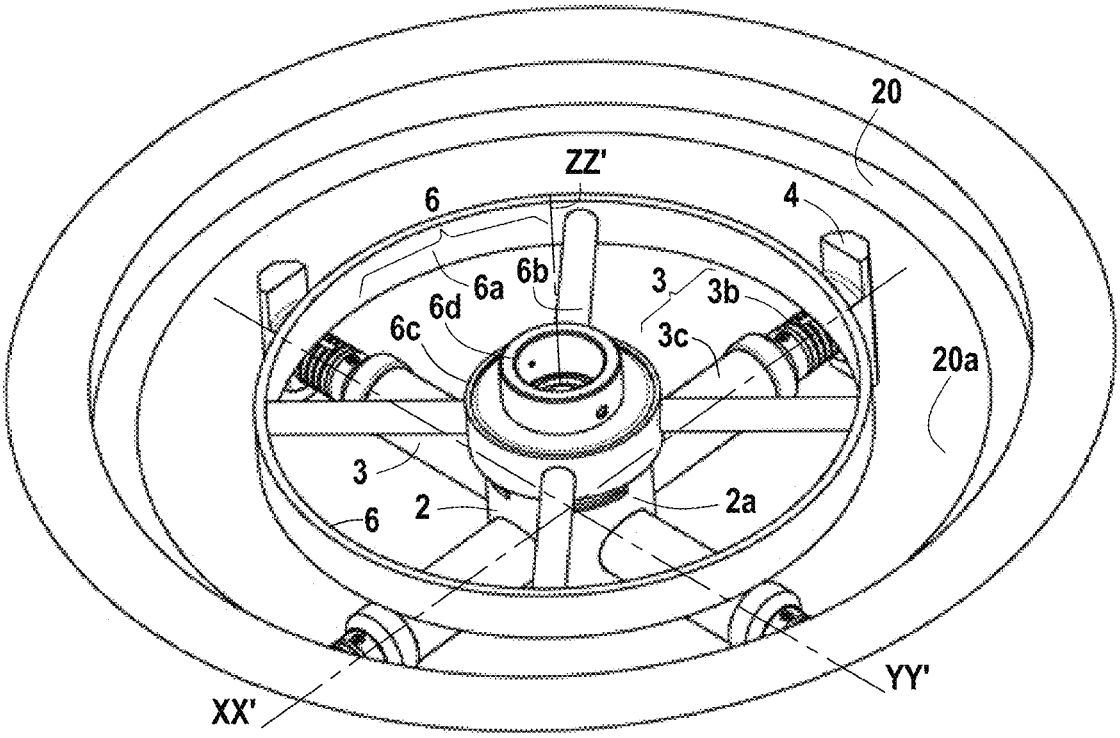
FIG. 2A represents a first variant of an obturation device according to the invention placed in a manhole 20 with a cylindrical vertical underground wall having a circular section 20*a*, with one said support and blocking element 2 supporting an obturation element 6.
Figure 2B:
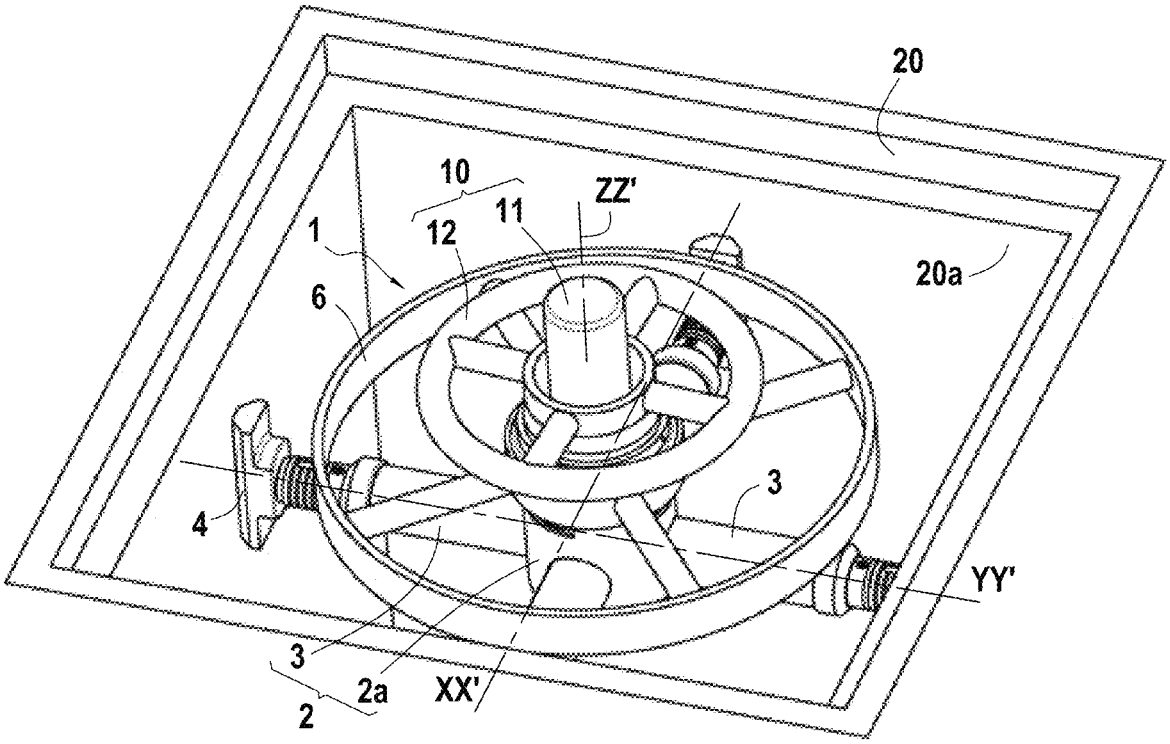
FIG. 2B represents a second variant of an obturation device according to the invention placed in a manhole 20 with a vertical cylindrical underground wall having a square section 20*b*, with one said support and blocking element 2 supporting an obturation element 6 and an actuation element 10.

FIGS. 1 and 2B show the obturation device according to the invention 1 with its 3 thus assembled elements 2, 3 and 10. FIGS. 2A and 2B show the obturation device according to the invention 1 in the blocking position with the blocking pads 4 in abutment against the cylindrical wall 20*a* by extension of the extensible rods 3*b* disposed in a radial plane XX', YY' perpendicular to the longitudinal axis of the central block 2*a* itself disposed coaxially with the axis ZZ' of the cylindrical walls 20*a* and 20*b*. In FIG. 2A, said actuation element 10 comprising a gripping element 12 and a geared motor 11 has been removed in order to be used for the set-up of another obturation device in another hole 20.

FIGS. 3A-3D show the structure and the operation of the arms 3 mounted on the central block 2*a* of the support and blocking element 2.

Each arm 3 comprises a drive shaft 3*a* disposed in one said longitudinal direction in a perpendicular radial plane XX', YY' with respect to said longitudinal axis ZZ' of said central block 2*a*. Each drive shaft 3*a* passes at a first end through an orifice 2-1 of the cylindrical wall 2*a*2 of the block 2*a* shown in FIG. 4 and ends at said first end by a bevel gear 5*a* opening out inside an empty space 2*a*3 delimited by the wall 2*a*2 of said central block 2*a*.

Figure 3A:
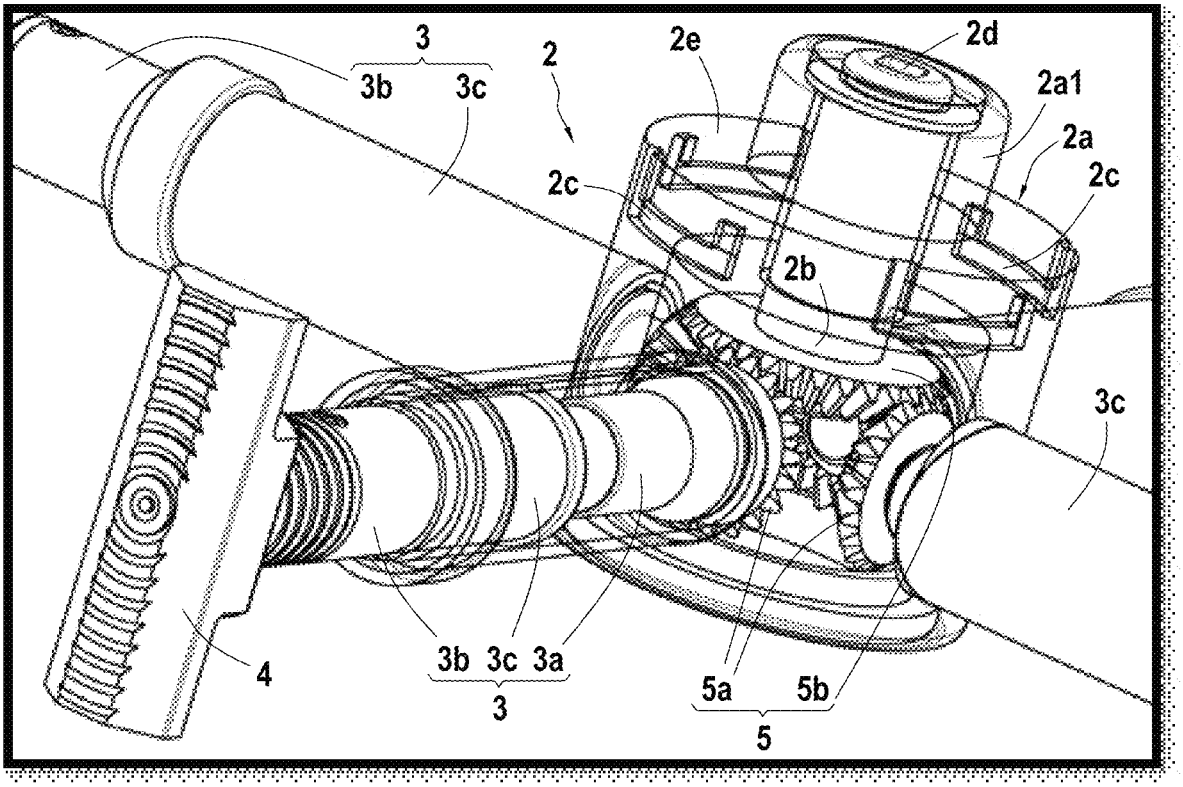
FIG. 3A represents a perspective view of said support and blocking element 2 of an obturation device according to the invention.

As shown in FIG. 3A, said central block 2*a* comprises an input shaft 2*b* disposed along the longitudinal axis ZZ' of said central block 2*a* and ends at its lower end by a bevel gear 5*b* inside the empty space 2*a*3 delimited by the wall 2*a*2 of said central block 2*a*. The bevel gear 5*b* at the end of the input shaft 2*b* is able to cooperate with the 4 gears 5*a* at the ends due to the drive shafts to form an angle transmission device 5. The input shaft 2*b* comprises an axial recess 2*d* open in the upper portion of the central block 2*a* able to receive and cooperate with the motor axis 11*a* of the geared motor 11. Thus, the input shaft 2*b* can be actuated in rotation on itself with respect to its longitudinal axis ZZ' when it cooperates with said motor shaft 11*a* of said actuation element 10 and when the geared motor is electrically actuated. The rotational actuation of said input shaft 2*b* allows actuating in rotation the meshed bevel pinions 5*a* and 5*b* of the angle transmission device 5 so that the rotation on itself along its longitudinal axis ZZ' of said input shaft 2*b* simultaneously drives the rotations on themselves of said drive shafts 3*a* along their axes in their said radial directions XX', YY'.

Figure 3B:
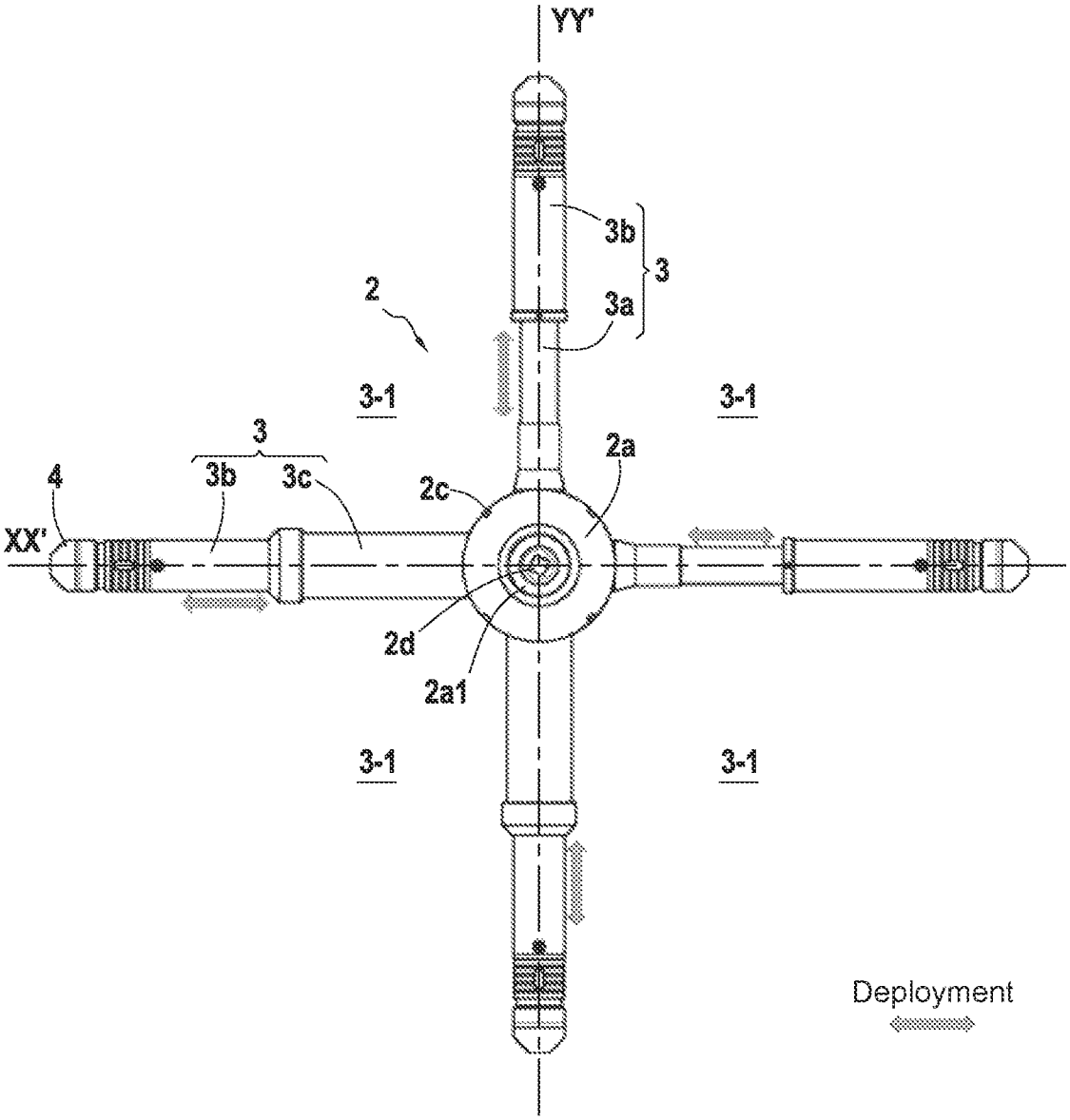
FIG. 3B represents a top view of one said support and blocking element 2 of an obturation device according to the invention.
Figure 3C:
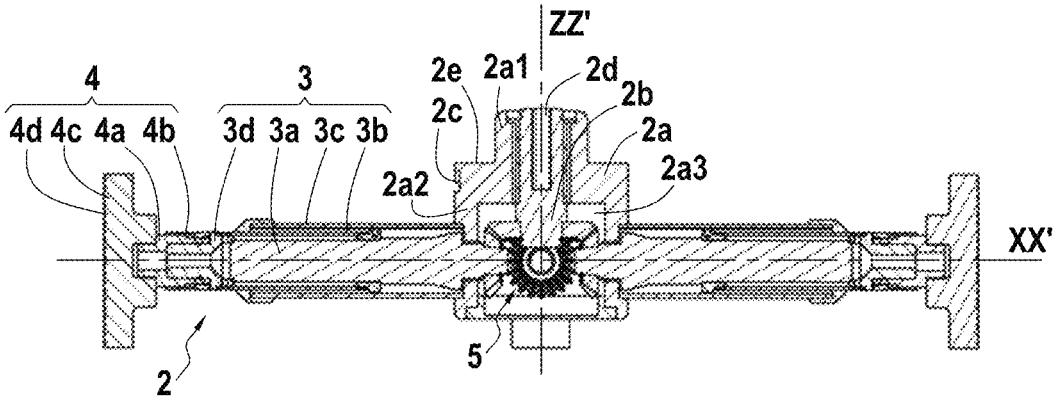
FIG. 3C represents an axial vertical sectional view along XX' of one said support and blocking element 2 of an obturation device according to the invention with the retracted rod 3*b*.
Figure 3D:
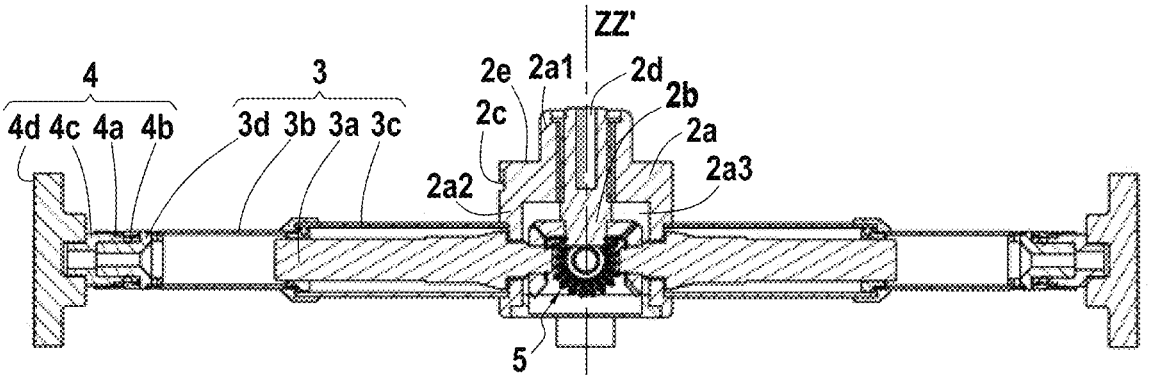
FIG. 3D represents an axial vertical sectional view along XX' of one said support and blocking element 2 of an obturation device according to the invention with the rod 3*b* in extension.

As shown in FIGS. 3B-3D and 4A-4B, each arm 3 comprises a drive shaft 3*a* comprising an external peripheral helical threading 3*a*1 forming a screw cooperating with a nut 3*b*1 engaged on the threading 3*a*1, said nut 3*b*1 being fastened to the end of a tubular extensible rod 3*b* able to coaxially cover said drive shaft 3*a* when the tubular rod 3*b* is in the retracted position with the nut 3*b*1 furthest from the central block 2*a* as shown in FIG. 3C and able to extend beyond the drive shaft 3*a* when the tubular rod 3*b* is in the extended position shown in FIG. 3D with the nut 3*b*1 furthest from the central block 2*a*.

A guide pin 3*b*2 on the periphery of the nut 3*b*1 cooperates with a rectilinear inner slot 3*cl* of a guide and protection cylinder 3*c* coaxially covering said drive shaft 3*a* and said tubular rod 3*b* in the retracted position. Thus, said drive shaft 3*a* is able to cooperate with said extensible tubular rod 3*b* in coaxial translation by helical link due to the fact that when said drive shaft 3*a* is driven in rotation on itself along its radial longitudinal axis XX', YY', said rotation on itself in either direction of said drive shaft 3*a* causes the translation of said tubular rod 3*b* in extension or respectively in retraction in one said radial direction XX', YY' due to the fact that the nut 3*b*1 and therefore said tubular rod 3*b* which is fastened thereto are prevented from rotating on themselves by the blocking and the guiding of the pin 3*b*2 in the slot 3*c*2 thus forcing said coaxial translation of said rod 3*b*. The tubular rod 3*b* slides in translation through a terminal ring 3*c*2 closing the annular space between the guide and protection cylinder 3*c* and the tubular rod 3*b* at the end of the guide and protection cylinder 3*c*.

In FIG. 3B, on the upper and right arms 3, the guide and protection cylinder 3*c* has not been represented to mount the drive shafts 3*a* which are otherwise concealed by said cylinders 3*c*. Said guide and blocking cylinder 3*c* also acts as a protection for the rod 3*b* and drive shaft 3*a* assembly in a helical link.

The free end of the tubular rod 3*b* furthest from the central block 2*a* comprises a pad 4 always remaining outside said guide and protection cylinder 3*c* when the rod 3*b* is in the maximum retracted position.

Figure 4:
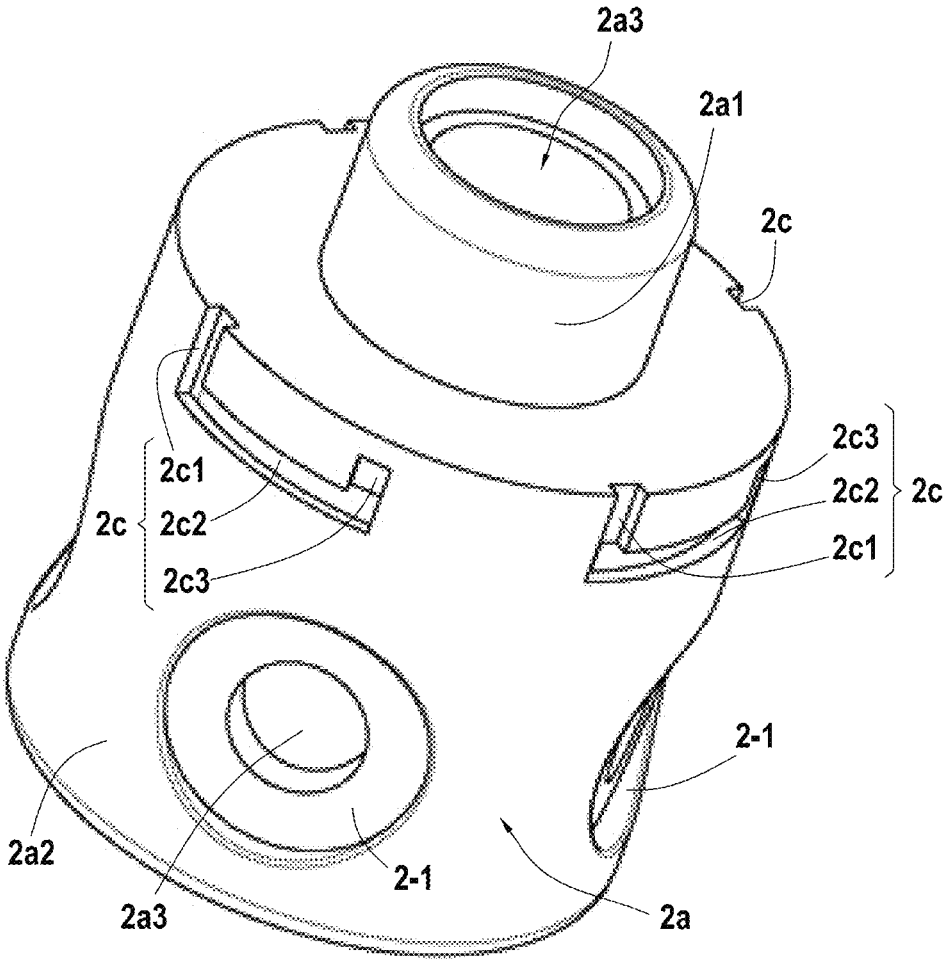
FIG. 4 represents a perspective view of the cylindrical walls 2*a*1 and 2*a*2 delimiting an empty space 2*a*3 of a central block 2*a* devoid of the input shaft 2*b* of one said support and blocking element 2.
Figure 4A:
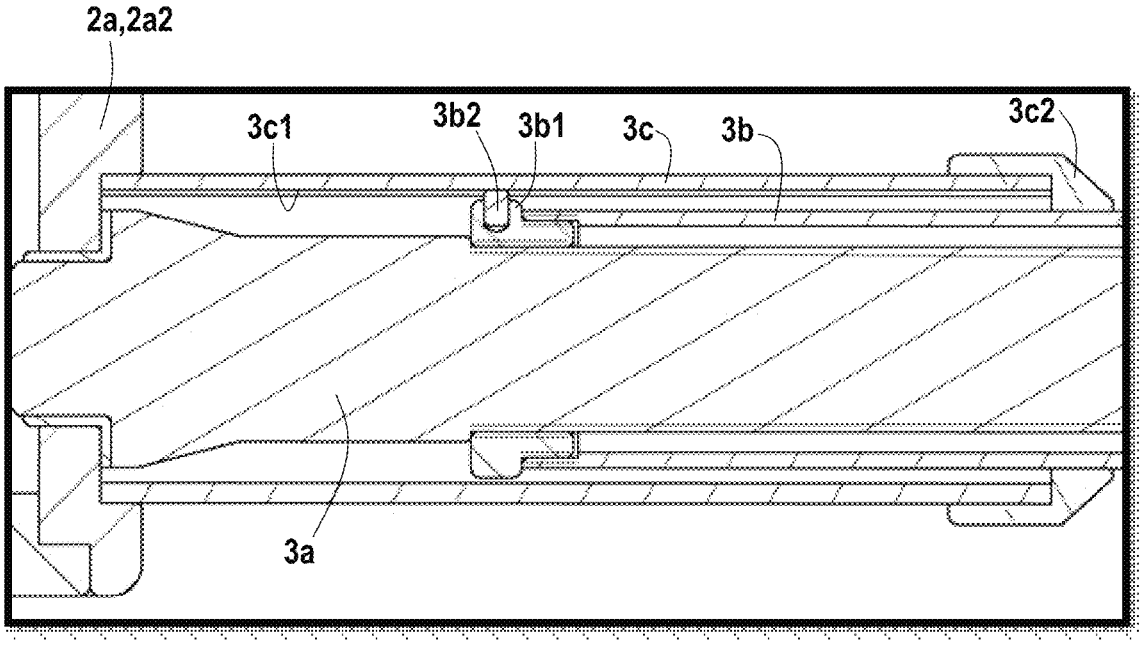
FIG. 4A represents an axial vertical sectional view along XX' showing the detail of the helical link of the drive shaft 3*a* and of the extensible rod 3*b* of an arm 3 of one said support and blocking element 2 of an obturation device according to the invention.
Figure 4B:
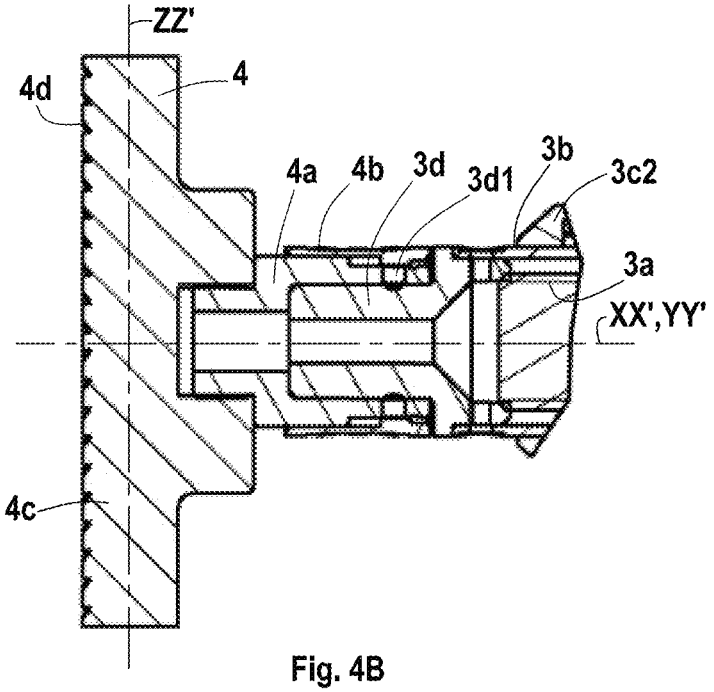
FIG. 4B represents an axial vertical sectional view along XX' showing the detail of the reversible link of the end of the extensible rod 3*a* with a pad 4 of one said support and blocking element 2 of an obturation device according to the invention.

FIG. 4B represents one embodiment of a reversible fastening of the pad 4 at the end of the rod 3*b* using a ball ring system by which a sliding ring on a cylindrical bead 4*a* of the pad 4 covers and holds a ball 3*dl* in a groove of a terminal part 3*d* at the end of the rod 3*b*. It suffices to pull the sliding ring 4*b* on the bead 4*a* to elastically release the ball 3*dl* out of the groove of the terminal part 3*d* at the end of the cylindrical rod 3*b* in order to be able to separate the pad 4 from the rod 3*b*. This reversible locking is quick and ergonomic. Thus, it is possible to change the pad 4 so that the latter has a shape adapted to the surface of the cylindrical side wall 20*a*, 20*b* of the passage 20 against which it must be applied in abutment.

The pad 4 comprises an end part 4*c* fastened to the bead 4*a* which ensures the link to the end of the arm 3, preferably an end part 4*c* made of rigid elastomer material. The end part 4*c* has a longitudinal shape in the direction ZZ' of the axis of the passage or hole 20. The end part 4*c* comprises a contact surface 4*d* with the cylindrical wall 20*a*, 20*b* of the passage 20 which has a cross-sectional contour in the plane XX', YY' which follows the cross-sectional contour of said cylindrical wall 20*a*, 20*b* in the plane XX', YY'.

Figure 5A:
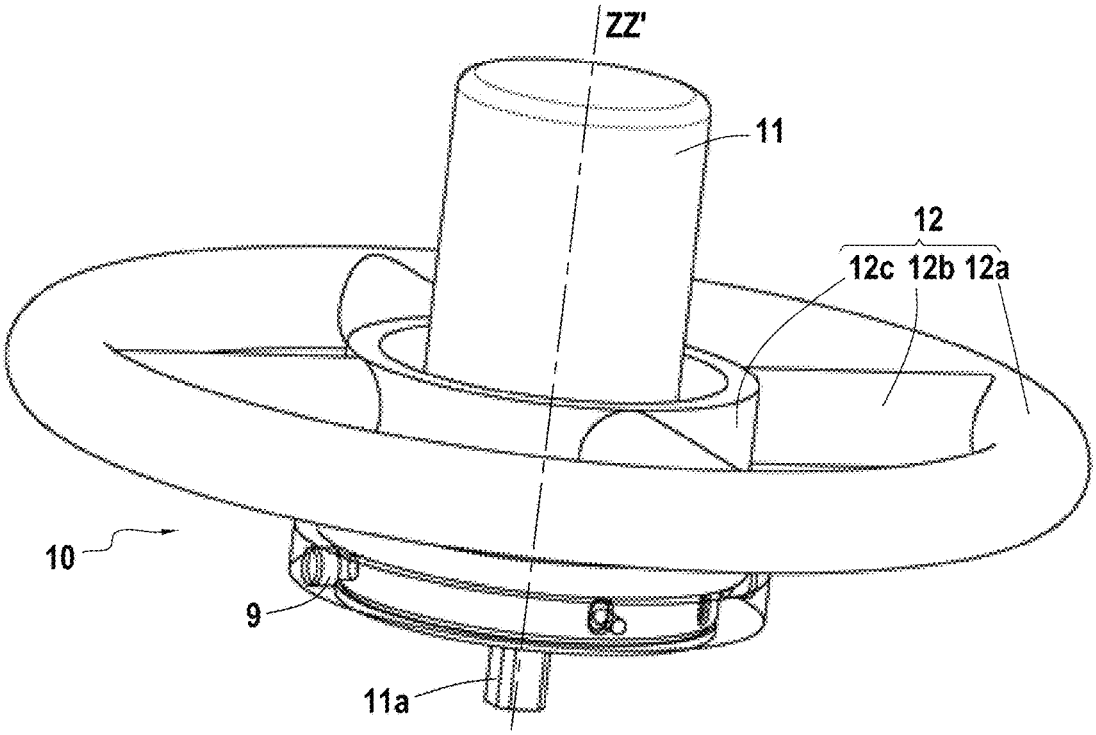
FIG. 5A represents a perspective view of an actuation element 10 with geared motor 11 and handwheel 12 with a magnet ring 9 on the underside.
Figure 5B:
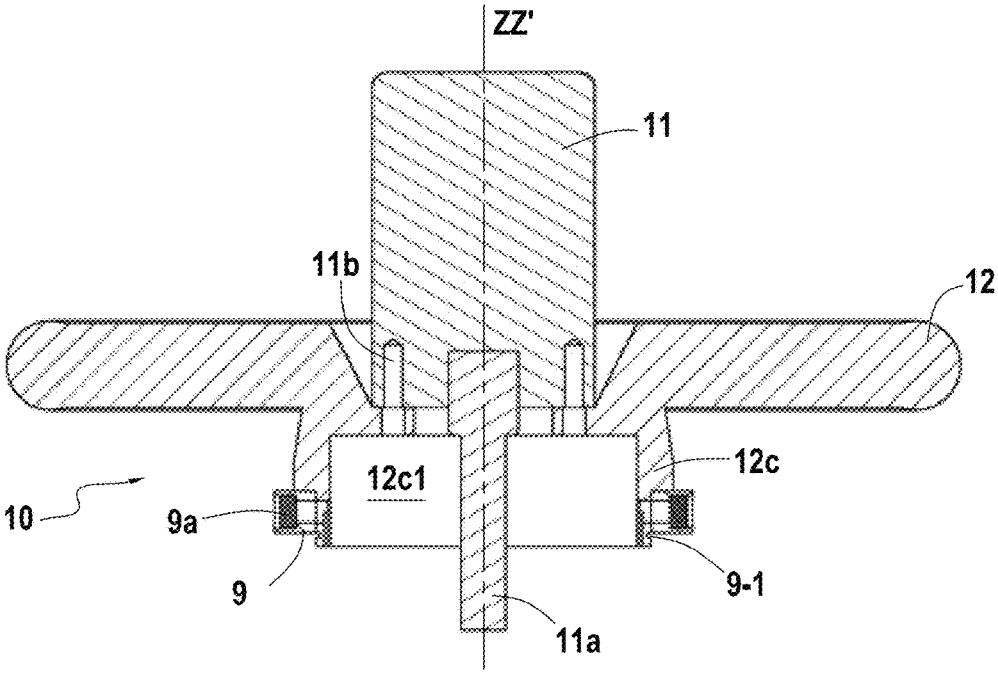
FIG. 5B represents an axial vertical sectional view along ZZ' of an actuation element 10 with geared motor 11 and handwheel 12 with a magnet ring 9 on the underside.
Figure 6A:
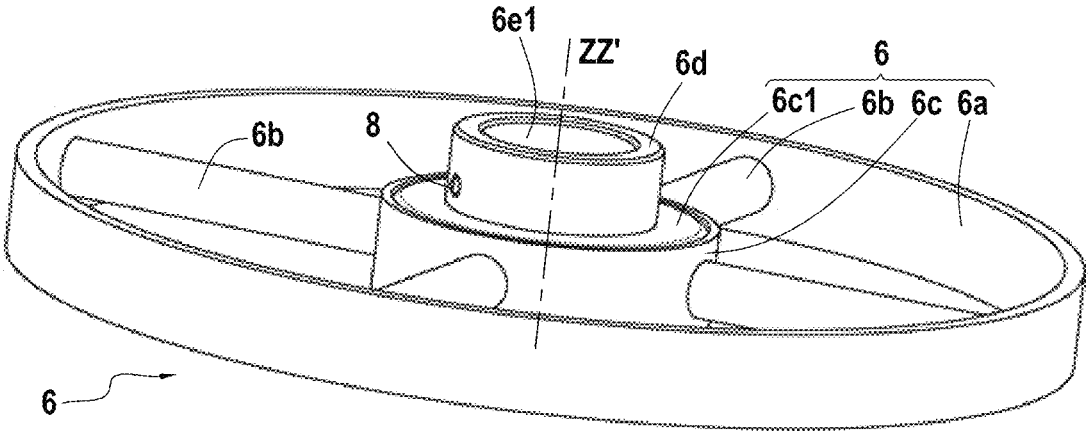
FIG. 6A represents a perspective view of a hoop-type obturation element 6.
Figure 6B:
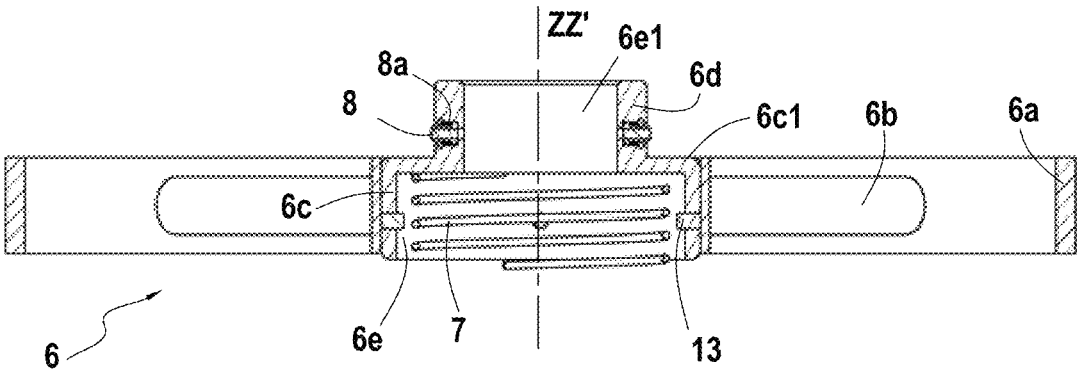
FIG. 6B represents an axial vertical sectional view along ZZ' of a hoop-type obturation element 6.

FIGS. 5A and 5B represent an actuation element 10 with geared motor 11 and a handwheel-shaped gripping element 12 and a magnet ring 9 on the underside intended for the reversible locking of said actuation element on a hoop-type obturation element 6 represented in FIG. 6A-6B.

The geared motor 11 is able to actuate in rotation place along the axis ZZ' of a passage 20 with a cylindrical wall 2*a*, 20*b*. A gripping element 12 comprises a circular handwheel 12*a* and a first coaxial central hub 12*c* linked to each other by first linking elements by forming first spokes 12*b* disposed in a cross (at 90°). The tubular wall of the first central hub 12*c* is surmounted by said geared motor which is fastened thereto by studs 11*b* and delimits a first central cylindrical recess 12*cl* traversed by said motor shaft 11*a* disposed coaxially along the axis ZZ'. On the underside of the tubular wall of the first central hub 12*c* is disposed coaxially a ring 9 which is fastened thereto by a circular fastener 9-1 coaxial along ZZ' so that the ring 9 is able to be driven manually in relative rotation with respect to said first central hub 12*c* to achieve the reversible locking of said actuation element on a hoop-type obturation element 6 represented in FIG. 6A-6B while maintaining said ring secured to the underside of the tubular wall of said first central hub 12*c*.

The ring 9 comprises two magnets 9*a* in two diametrically opposed first empty housings 9*b*.

FIGS. 6A-6B represent a hoop-type obturation element 6 comprising:

- a second central hub 6*c* of axis ZZ' and a peripheral circular rim 6*a* of axis ZZ' when the element is in place coaxially on the device of the invention 1 in the passage 20, and
- 4 second spokes 6*b* disposed in a cross (at 90°) in a radial plane XX', YY' ensuring the link with respect to a second central hub 6*c* of axis ZZ' and a wheel rim 6*a*.

The hoop 6 is intended to be positioned above the support and blocking element 2 with the second spokes 6*b* disposed from the 4 arms 3 in the directions of the bisectors of the empty spaces 3-1 between two adjacent arms 3. The second spokes 6*b* have a length such that the rim 6*a* arrives at the level of the end 3*c*2 of the protection cylinder 3*c*. In practice, the hoop 6 and the protection cylinders 3*c* of the arms 3 are dimensioned such that the arms 3 being in maximum extension with the pads 4 in abutment on the lateral surface 20*a*, 20*b*, the rim 6*a* arrives approximately to the half the length of said arms 3, that is to say the length of the protection cylinders 3*c* represents approximately half the length of said bars 3 in maximum extension.

The second central hub 6*c* is of tubular shape delimiting a coaxial cylindrical internal recess 6*e* of axis ZZ'. The second central hub 6*c* is surmounted by a coaxial upper portion 6*d* of cylindrical tubular shape forming a shoulder 6*cl* at the junction between the second central hub 6*c* and its upper portion 6*d*. The upper portion 6*d* delimits an internal recess 6*el* of smaller diameter than the recess 6*e* and communicating therewith.

Figure 7A:
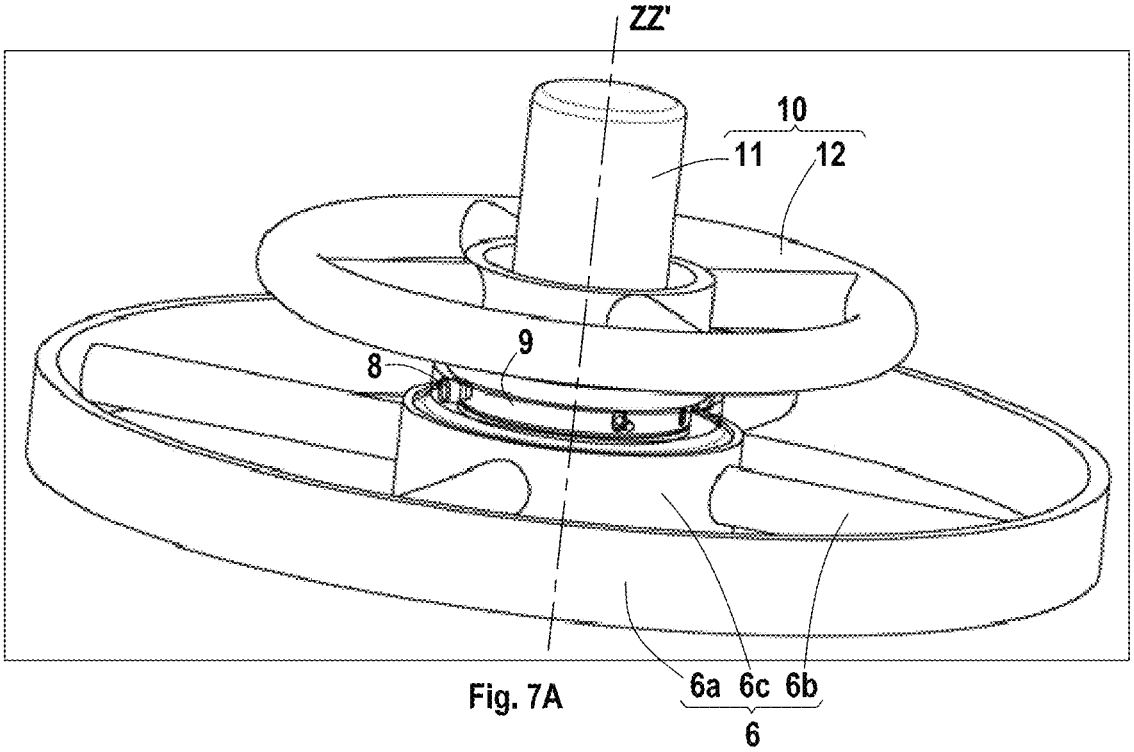
FIG. 7A represents a perspective view of the fastening of an actuation element 10 of FIGS. 5A and 5B on a hoop-type obturation element 6 of FIGS. 6A and 6B.
Figure 7B:
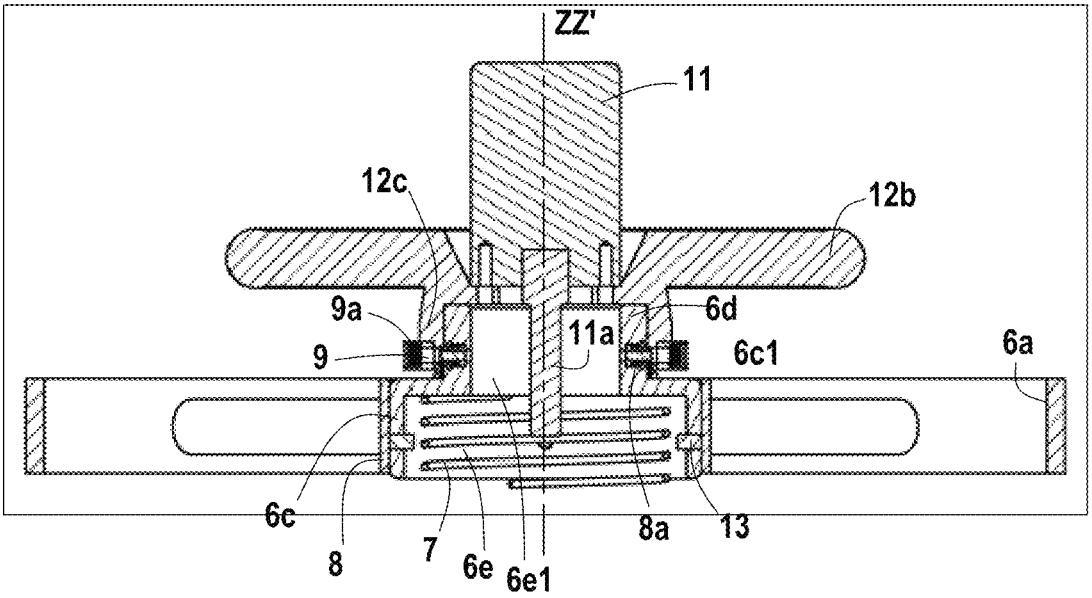
FIG. 7B represents an axial vertical sectional view along ZZ' of the fastening of an actuation element 10 of FIGS. 5A and 5B on a hoop-type obturation element 6 of FIGS. 6A and 6B.
Figure 8A:
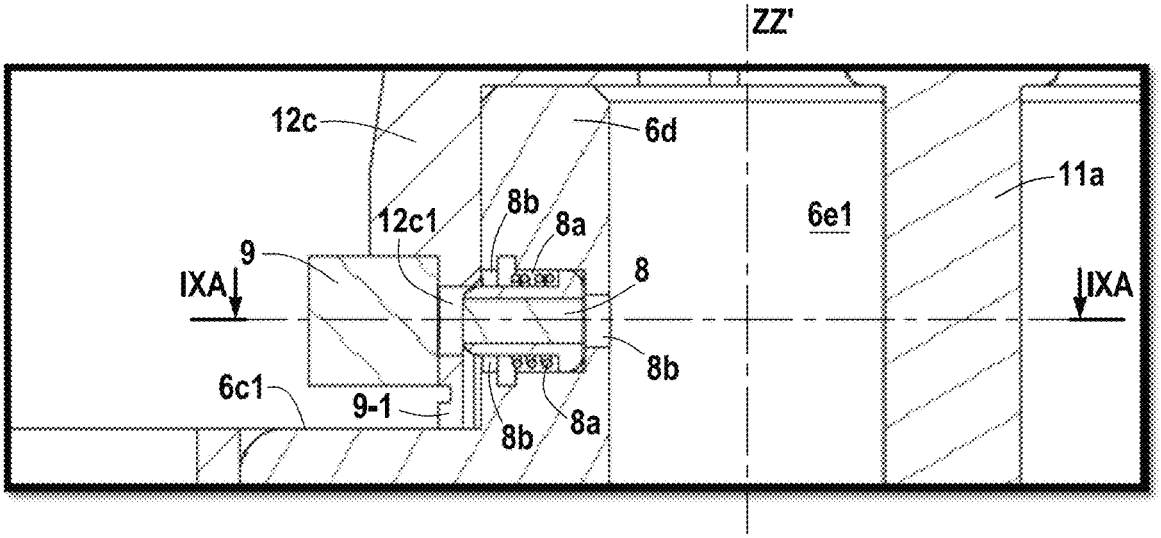
FIG. 8A represents an axial vertical sectional view along ZZ' of the detail of the operating mode of the fastening of an actuation element 10 on a hoop-type obturation element 6 of FIGS. 7A and 7B, showing the cooperation of the magnet ring 9 and of the first locking pin 8 without locking.
Figure 8B:
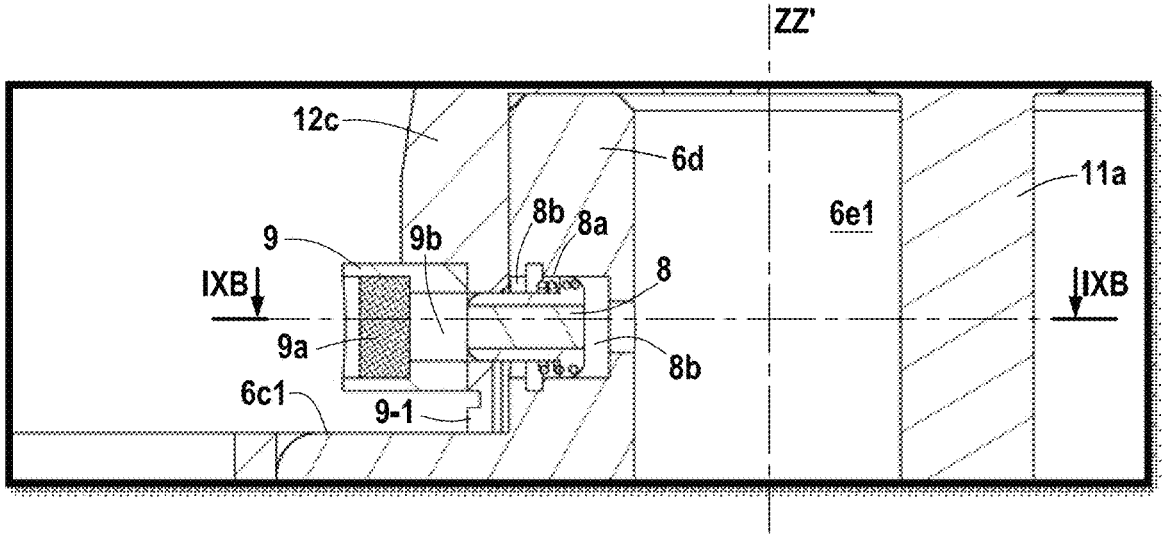
FIG. 8B represents an axial vertical sectional view along ZZ' of the detail of the operating mode of the fastening of an actuation element 10 on a hoop-type obturation element 6 of FIGS. 7A and 7B, showing the cooperation of the magnet ring 9 and of the first locking pin 8 in the locking position before locking.
Figure 9A:
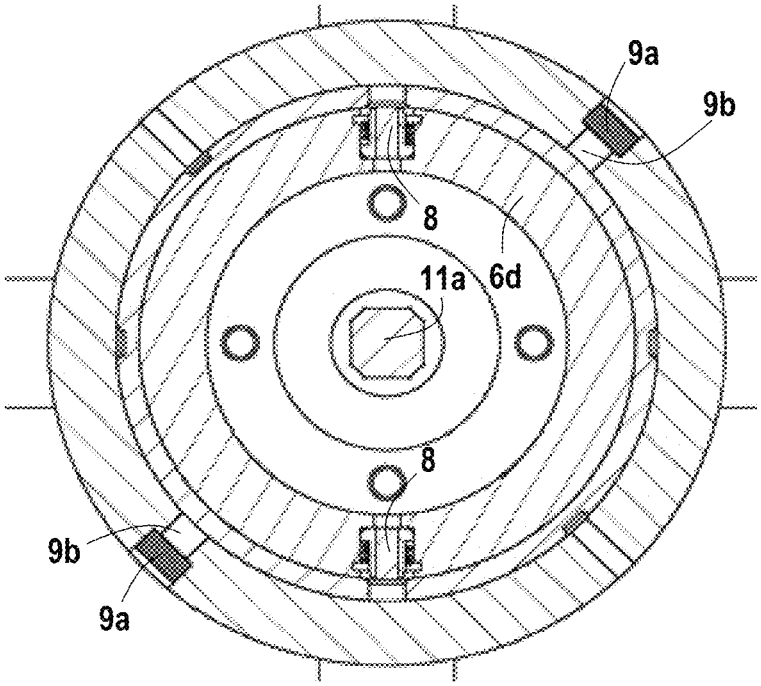
FIG. 9A represents a horizontal sectional view along AA of FIG. 8A.
Figure 9B:
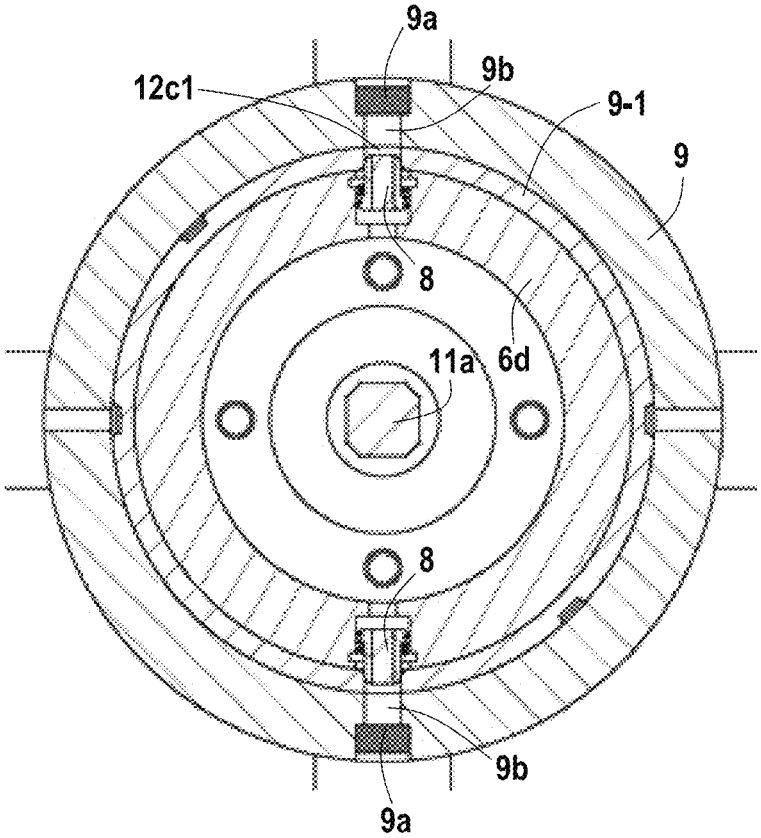
FIG. 9B represents a horizontal sectional view along AA of FIG. 8B.

The shoulder 6*cl* is able to support the circular fastener 9-1 and the ring 9 on the underside of the tubular wall of the first central hub 12*c* when said actuation element 10 comprising the geared motor 11 and the handwheel 12 are assembled on the hoop 6 by coaxially threading the ring 9 and the tubular wall of the first central hub 12*c* on the upper portion 6*d* surmounting the second central hub 6*b* as shown in FIGS. 7A-7B.

The tubular wall of the upper portion 6*d* surmounting the second central hub 6*c* comprises at its lower end close to the shoulder 6*c*1, two diametrically opposed second hollow housings 8*b* enclosing respectively two first locking pins 8.

A second coaxial spring 7 which serves for the reversible locking of the hoop 6 on the support and blocking element 2 is disposed within the recess 6*e* delimited by the tubular wall of the first central hub 12*c*. The tubular wall of the first central hub 12*c* has four second locking pins protruding on its inner face protruding towards the central recess 6*e*. The second spring 7 and the second locking pins are able to cooperate with outer slots 2*c* on the periphery of the walls of the central block 2*a* of the support and blocking element 2 in order to achieve a reversible locking of the hoop 6 on the central block 2*a*.

In FIGS. 8A-9A, the ring 9 is in a position of relative with respect to the second central hub 6*c* and its upper portion 6*d* such that the two first locking pins 8 are held in the hollow housings 8*b* by compressing first springs 8*a* due to the fact that the first hollow housings 9*b* are not positioned opposite the second hollow housings 8*b*.

In FIGS. 8B-9B, the ring 9 is in a position of relative rotation with respect to the second central hub 6*c* and its upper portion 6*d* such that the two first hollow housings 9*b* are positioned opposite the second hollow housings 8*b*. Thus, the first two metal locking pins 8 are ready to be attracted by the magnets 9*a* and leave the second hollow housings 8*b* by extension of the first springs 8*a* due to the fact that the first hollow housings 9*b* are not positioned opposite the second hollow housings 8*b*. A new rotation of the ring 9 will cause the entry of the first two metal locking pins 8 into the second hollow housings 8*b* and the compression of the first springs 8*a*.

FIGS. 10A-11A, 10B-11B, 10C-11C represent the operation of the second reversible locking means allowing the reversible fastening of the hoop 6 on the central block 2*a* of said support and blocking element 2, by movements of relative axial rotation and translation of the assembly of said actuation element 10 fastened to said obturation element 6 with respect to said support and fastening element 2, along and respectively about said longitudinal axis ZZ'.

FIG. 4 represents the outer wall of said central block 2*a* comprising four slots 2*c* each comprising a first vertical portion 2*cl* along the longitudinal direction (ZZ') of said block, a second circular-arc portion 2*c*2 on the periphery of said cylindrical block 2*a* corresponding for example to a 45° rotation, and a third vertical portion 2*c*3, said second circular-arc portion 2*c*2 forming the junction of the lower ends of said first and third vertical portions 2*c*1, 2*c*3, said first vertical portion 2*cl* being open at its upper end and said third vertical portion 2*c*3 being closed at its upper end.

Figures 10A, 10B, 10C:
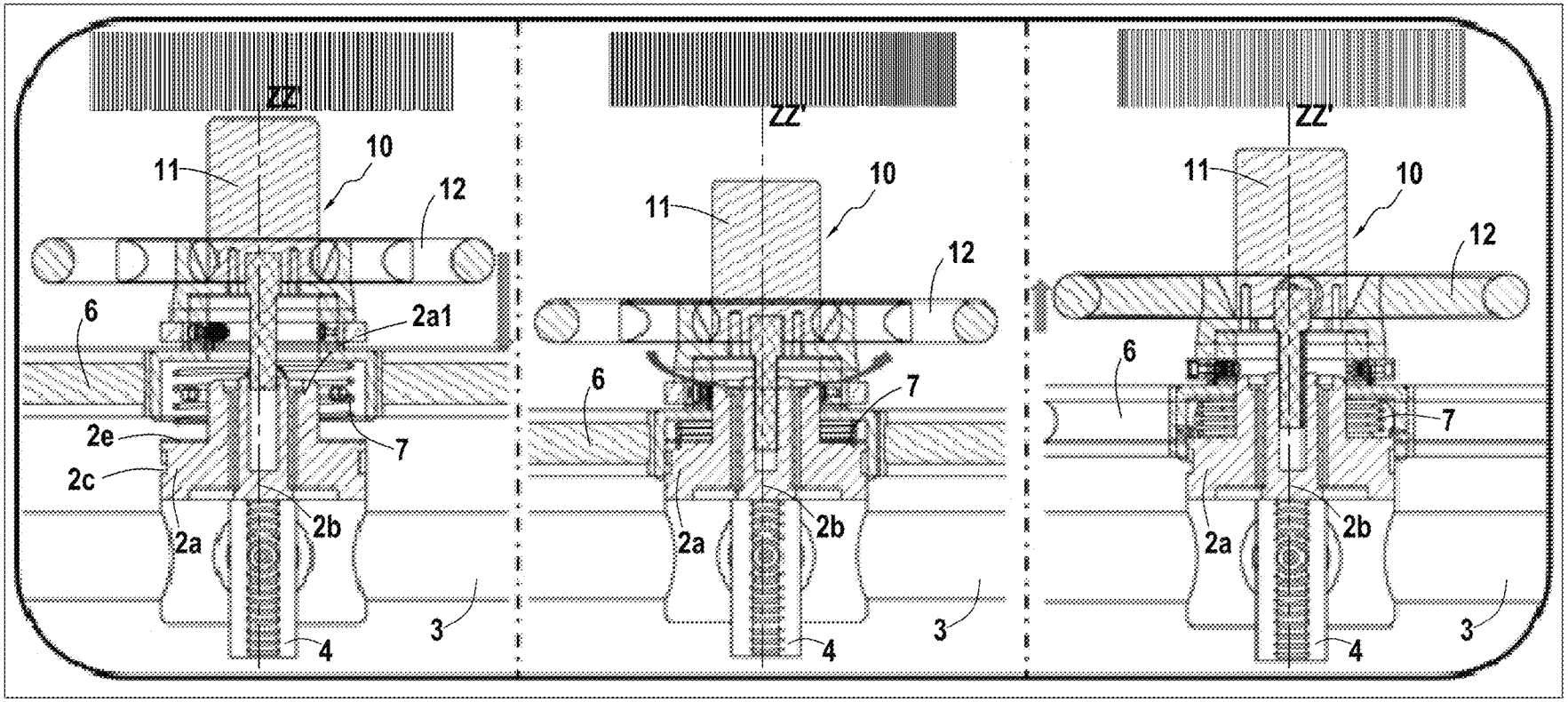
FIG. 10 comprises FIGS. 10A-10C which represent vertical sectional views along ZZ' showing the cooperation of a locking pin 13 of a central hub 6*c*-6*d* of a hoop-type obturation element 6 during its locking on a central block 2*a* of one said support and blocking element 2 by movements of vertical translation and rotation along ZZ' of said assembly 10, 6 with respect to said central block 2*a* according to FIGS. 10A-10C respectively.

FIG. 10A shows a first downward vertical translational movement of the assembly of said actuation element 10 fastened to said obturation element 6 with respect to said central block 2*a* and coaxially therewith along its longitudinal axis ZZ, by engaging the motor shaft 11*a* in an upper axial orifice 2*d* of the input shaft 2*b* of said central block 2*a*, before the second central hub 6*c* of the hoop 6 abuts on the shoulder 2*e* of the central block 2*a*, the second spring 7 being in extension.

Figure 11C:
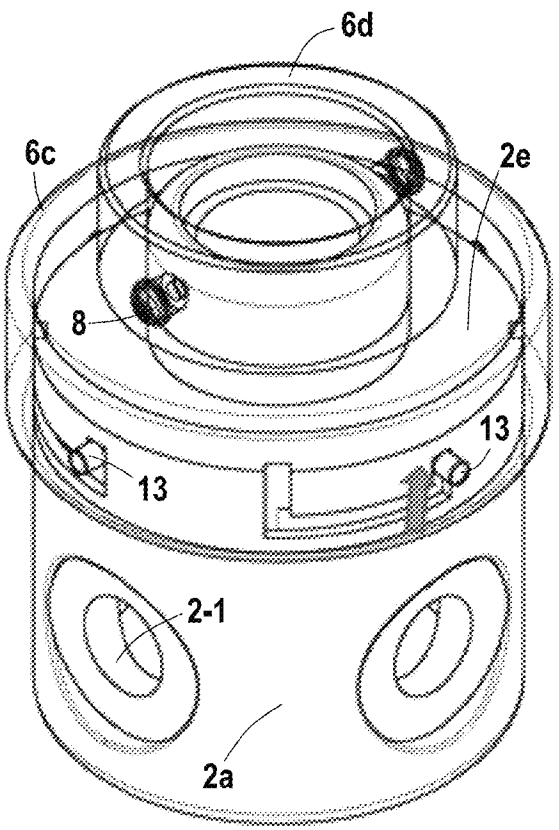
FIG. 11 comprises FIGS. 11A-11C which represent perspective views showing the cooperation of a locking pin 13 of a central hub 6*c*-6*d* of a hoop-type obturation element 6 during its locking on a central block 2*a* of one said support and blocking element 2 by movements of vertical translation and rotation along ZZ' of said assembly 10, 6 with respect to said central block 2*a* according to FIGS. 10A-10C respectively.
Figure 11B:
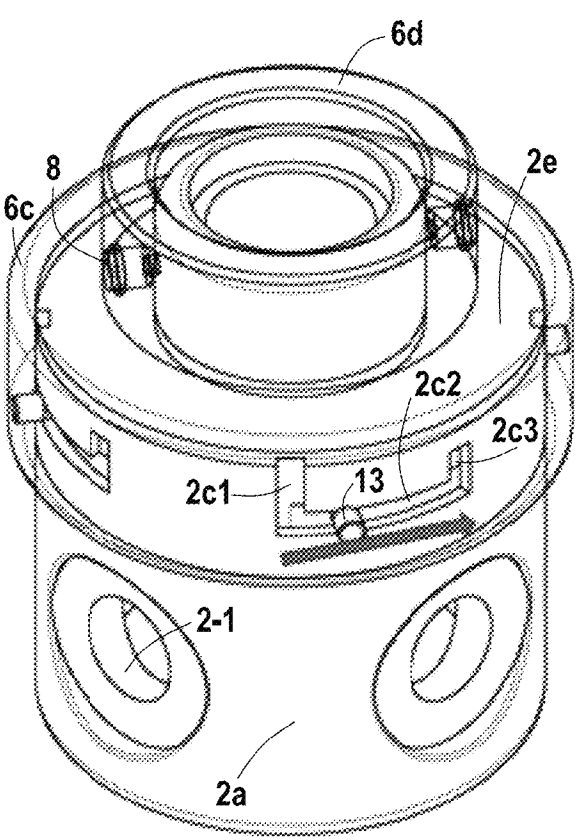
Figure 11A:
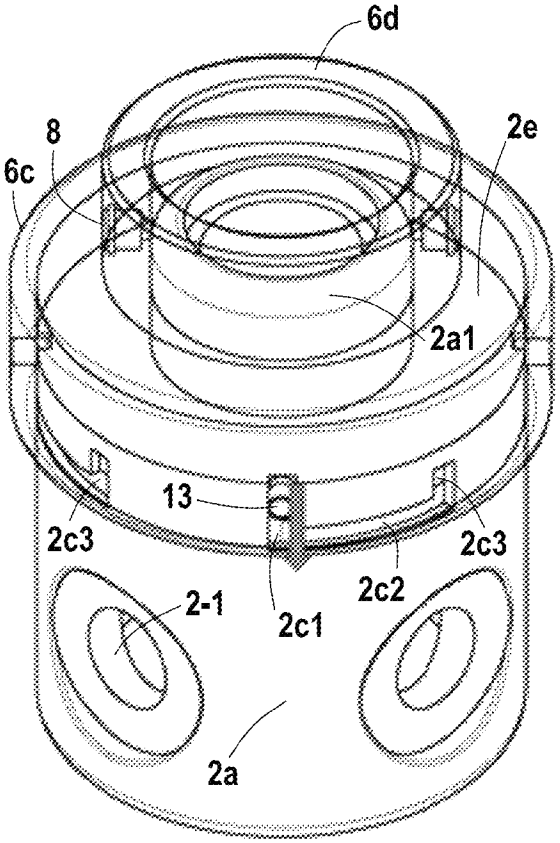

FIG. 11A shows the sequence of the first downward vertical translational movement of the assembly of said actuation element 10 fastened to said obturation element 6 with respect to said central block 2*a* and coaxially therewith along its longitudinal axis ZZ', said second blocking pin 13 of the hoop 6 being engaged and guided in translation in said first vertical slot portion 2*c*1. This first movement continues until the second central hub 6*c* of the hoop 6 abuts on the shoulder 2*e* of the central block 2*a* and the pin 13 arrives at the lower end of said first vertical slot portion 2*cl* by compressing said second spring 7 in doing so as shown in FIG. 10B. This first downward vertical translational movement is facilitated by the gripping and the axial positioning of the assembly of said actuation element 10 fastened to said obturation element 6 with respect to said central block 2*a*, using the handwheel 12.

At this stage, as shown in FIG. 11B, by turning the handwheel 12, a second rotational movement of the assembly of said actuation element 10 fastened to said obturation element 6 with respect to said central block 2*a* is carried out, said second blocking pin 13 thus being guided in rotation in said second circular slot portion 2*c*2 up to the lower end of said third vertical slot portion 2*c*3, while keeping said second spring 7 compressed.

FIGS. 10C and 11C show a third upward vertical translational movement of the assembly of said actuation element 10 fastened to said obturation element 6 with respect to said central block 2*a* and coaxially therewith along its longitudinal axis ZZ', said second blocking pin 13 thus being guided in translation in said third vertical slot portion 2*c*3 up to its upper end due to the extension of said second spring 7.

The obturation device according to the invention is an articulated system of 4 arms that allows blocking the passage of a manhole. The arm extension system has been described as being preferably an electromechanical system operating via a screw-nut system to make a helical link causing the deployment of the rod accompanied by a gear torque multiplier to provide the required force with bevel gears to redirect the axes of rotation. The input shaft 2*b* is rotated via the motor axis 11*a* and the bevel gear system 5 allows the redirection of the main rotation on the 4 secondary shafts 3*a* which drive the helical link (screw-nut). Thus, also thanks to the blocking of the rotation of the output rod 3*b* via a slot 3*cl* in the guide 3*c*, the system is deployed. It is under stress during the contact of the pads 4 with the walls of the manhole 20.

However, they can be substituted with hydraulic or pneumatic jacks, thus providing a slide link or sliding pivot link rather than a helical link, said jacks being coupled on a hydraulic or pneumatic fluid supply. In this case, manual pre-adjustment is required to reduce the used volume of fluid.

The obturation device according to the invention is adaptable to all manhole geometries and dimensions thanks to a stress made on the walls of the hole by activation of the arm extension system.

The obturation device according to the invention is mainly used for prevention in case of flooding (the system can be sealed), prevention during work, or obturation of possible exits in the event of an attack. In these multiple cases, the obturation device according to the invention allows preventing a person from falling through the manhole or prohibiting the voluntary passage of an individual.

A method for setting up an obturation device according to the invention 1 in order to transversely obstruct a passage 20 delimited by a cylindrical side wall 20*a*, 20*b*, comprises the steps of:

1) fastening on said obturation element 6, one said actuation element 10 comprising a handwheel-shaped gripping element 12, then
2) fastening on said central block 2*a* of said support and blocking element 2, the assembly of said actuation element 10 assembled with said obturation element 6, and
3) positioning, using the handwheel-shaped gripping element 12, the device according to the invention in said passage 20 with the extensible rods 3*b* of said arms in the retracted position, said arms being disposed in a perpendicular radial plane XX', YY' with respect to said longitudinal axis ZZ' of said central block 2*a* itself disposed coaxially with the axis of said passage 20, and
4) actuating the geared motor 11 to actuate in extension said four extensible rods 3*b* simultaneously said arms 3 in extension to block said pads 4 in abutment against the cylindrical wall 20*a*, 20*ab* of said passage as shown in FIG. 2A-2B, and
5) removing said removable actuation element 10 to let in the passage only the assembly of said support and blocking element 2 and said obturation element 6 as shown in FIG. 2A.

The obturation hoop 6 is locked via a simple mechanical action made by the user on the handwheel 12. The locking pins 13 must therefore be aligned with the slots 2*cl* present on the central block 2*a*. Then, the assembly is depressed, and a 45° rotation is exerted in the slot 2*c*2. Finally, the handwheel 12 is loosened, which allows the assembly to move up thanks to the spring 7. The locking pins 12 will thus be blocked in the slot 2*c*3. The unlocking is simple: the actions listed in reverse order must be made.

In step 5), the separation of the handwheel 12 is exerted by a simple 30° rotation of the magnet ring 9.

The invention claimed is:

1. A removable obturation device for transversely obstructing a passage delimited by a cylindrical side wall having a longitudinal axis, comprising:

a) a support and blocking element comprising a central block having a longitudinal axis configured to be positioned in the longitudinal axis of said side wall of said passage, the central block supporting a plurality of different arms disposed perpendicularly in a radial position with respect to said longitudinal axis of said central block, the different arms being disposed symmetrically with respect to said longitudinal axis of said central block;

each arm comprising an extensible rod comprising a pad at a free end thereof, the pad fastened in a reversible manner to the free end of said extensible rod, configured to be blocked in abutment against one said side wall by extension of said extensible rod, and b) at least one complementary hoop-shaped obturation element extending in a transverse plane perpendicular to said longitudinal axis of said passage, at least partly in or opposite a space between said arms so as to prevent an individual from falling through said passage, said obturation element being removably fastened to said support and blocking element;

c) a removable actuation element configured to cooperate with said central block to actuate in extension or retraction said extensible rods of said arms simultaneously, said actuation element comprising first reversible fastening means on said support and blocking element, at said central block, said first reversible fastening means configured to reversibly fasten said actuation element on said obturation element.

2. The device according to claim 1, wherein said support and blocking element comprises four said arms disposed in a cross at 90° around the central block.

3. The device according to claim 1, wherein said actuation element comprises a handwheel-shaped gripping element around a geared motor to which fastened.

4. The device according to claim 1, wherein said actuation element comprises a geared motor configured to actuate in rotation along a longitudinal axis of a motor shaft, and said support and blocking element comprises:

a1) said arms each comprising one drive shaft disposed in one longitudinal direction in a perpendicular radial plane with respect to said longitudinal axis of said central block, each said drive shaft being configured to be driven in rotation along a radial longitudinal axis thereof and configured to cooperate with one said extensible rod in coaxial translation by helical link such that rotation in either direction of said drive shaft causes translation of said extensible rod in extension or respectively in retraction in one radial direction, and a2) one said central block comprising an input shaft disposed along the longitudinal axis of said central block and configured to be actuated in rotation with respect to a longitudinal axis of the input shaft when cooperates with said motor shaft of said actuation element, and an angle transmission device comprising bevel gears configured to cooperate with each other at ends of said input shaft and said drive shafts so that rotation along the longitudinal axis of said input shaft simultaneously causes rotations on of said drive shafts along respective axes in radial directions.

5. The device according to claim 4, wherein said helical link is a screw-nut helical link, said drive shaft comprising an external helical threading forming a screw cooperating with a tubular rod at least one end portion of which forms a nut engaged on the threading of the threaded screw formed by said drive shaft, said nut being prevented from following said rotation of said drive shaft and said tubular rod being guided in said translation by a guide pin of said nut due to said guide pin cooperates with a rectilinear inner slot of a guide and protection cylinder inside which said drive shaft and one end portion at least of said tubular rod extend coaxially, free end of the rod comprising said pad always remaining outside said guide and protection cylinder.

6. The device according to claim 1, wherein said obturation element comprises a single obturation element extending above said arms, configured to be removably fastened to said support and blocking element at said central block.

7. The device according to claim 6, wherein said obturation element comprises a hoop linked to a central hub by spokes, said central hub of said hoop being configured to be removably fastened to said support and blocking element around said central block so that said spokes of the hoop extend between said arms, along bisectors of angles between said arms.

8. The device according to claim 1, wherein said actuation element comprises said first reversible fastening means on said obturation element, at a central hub of said hoop-shaped obturation element, and comprising second reversible fastening means on said support and blocking element, at said central block.

9. The device according to claim 8, wherein said actuation element comprises a handwheel-shaped gripping element around a geared motor to which fastened, said handwheel comprising first reversible locking means allowing blocking of the reversible fastening of said actuation element on said obturation element, by a movement of relative axial rotation about longitudinal axis of a magnet ring rotating with respect to said handwheel and on underside of said handwheel, at least one magnet of said ring being configured to cooperate with respectively at least a first metal elastic locking pin in a hole of said obturation element, said first metal locking pin being configured to leave said hole attracted against said magnet, by a first spring, when positioning of said actuation element with respect to said obturation element on and the rotation of said ring places said magnet opposite the first elastic locking pin of said obturation element, opposite a first elastic locking pin in a hole at a central hub of said hoop-shaped obturation element.

10. The device according to claim 9, wherein said obturation element comprises second reversible locking means allowing a blocking of the reversible fastening on said support and blocking element of assembly of said actuation element fastened to said obturation element, by movements of relative axial rotation and translation with respect to said support and blocking element of the assembly of said actuation element fastened to said obturation element, along and respectively about a longitudinal axis thereof.

11. The device according to claim 10, wherein said hoop-shaped obturation element and said second reversible locking means comprise:

at a central hub of said obturation element, at least a second locking pin and a second spring in a cylindrical recess within said central block, and on outer wall of said central block, at least one locking slot comprising a first vertical portion along longitudinal direction of said block, a second circular-arc portion on periphery of said block and a third vertical portion, said second circular-arc portion forming junction of lower ends of said first and third vertical portions, said first vertical portion being open at an upper end and said third vertical portion being closed at the upper end, so that said second reversible locking means are configured to be actuated in locking by:

a first downward vertical translational movement of the assembly of said actuation element fastened to said obturation element with respect to said central block and coaxially therewith along a longitudinal axis thereof, said second locking pin thus being configured to be guided in translation in said first vertical slot portion up to a lower end by compressing said second spring in doing so, a second rotational movement of the assembly of said actuation element fastened to said obturation element with respect to said central block, said second locking pin thus being configured to be guided in rotation in said second circular slot portion up to the lower end of said third vertical slot portion, keeping said second spring compressed, and a third upward vertical translational movement of the assembly of said actuation element fastened to said obturation element with respect to said central block and coaxially therewith along a longitudinal axis thereof, said second locking pin thus being configured to be guided in translation in said third vertical slot portion up to the upper end due to extension of said second spring.

12. A method of setting up the obturation device according to claim 1, comprising:

a) positioning the obturation device in said passage with the extensible rods of said arms in the retracted position, said arms being disposed in a perpendicular radial plane with respect to said longitudinal axis of said central block disposed coaxially with the axis of said passage, and b) actuating, by means of one said actuation element, said arms to block said pads in abutment against the cylindrical wall of said passage by extension of the said extensible rods, said actuation element cooperating with said central block to actuate in extension said extensible rods of said arms simultaneously.

13. The method according to claim 12, comprising preliminary steps of:

a1) fastening on said obturation element one said actuation element comprising a handwheel-shaped gripping element, then a2) fastening said actuation element assembled with said obturation element on said central block of said support and blocking element.

14. The method according to claim 12, further comprising:

a) positioning said obturation device in said passage with the extensible rod of said arms in the retracted position, using a handwheel-shaped gripping element fastened around a geared motor of said removable actuation element, and b) actuating said arms to block said pads in abutment against the cylindrical wall of said passage by extension of said extensible rods using said geared motor of said actuation element, and c) removing said removable actuation element to let in the passage only said support and blocking element and said obturation element.

* * * * *